US010138055B2

(12) United States Patent
Axisa

(10) Patent No.: US 10,138,055 B2
(45) Date of Patent: Nov. 27, 2018

(54) CHUTE SYSTEM FOR WASTE AND OTHER MATERIALS

(71) Applicant: Anthony Axisa, Brisbane (AU)

(72) Inventor: Anthony Axisa, Brisbane (AU)

( * ) Notice: Subject to any disclaimer, the term of this patent is extended or adjusted under 35 U.S.C. 154(b) by 0 days.

(21) Appl. No.: 15/685,208

(22) Filed: Aug. 24, 2017

(65) Prior Publication Data

US 2018/0058079 A1 Mar. 1, 2018

(51) Int. Cl.

| | |
|---|---|
| ***B65F 1/00*** | (2006.01) |
| ***E04F 17/12*** | (2006.01) |
| ***E05F 15/73*** | (2015.01) |
| ***B07C 5/34*** | (2006.01) |
| ***B65F 1/14*** | (2006.01) |

(52) U.S. Cl.

CPC ..... *B65F 1/0093* (2013.01); *B07C 5/3404* (2013.01); *B65F 1/004* (2013.01); *B65F 1/141* (2013.01); *E04F 17/12* (2013.01); *E05F 15/73* (2015.01); *B07C 2301/00* (2013.01); *B65F 2001/008* (2013.01); *B65F 2210/1125* (2013.01); *B65F 2210/1126* (2013.01); *B65F 2210/148* (2013.01); *B65F 2210/1443* (2013.01); *B65F 2210/168* (2013.01); *B65F 2210/18* (2013.01)

(58) Field of Classification Search

CPC .... B65F 1/0093; B65F 2001/008; E04F 17/12
See application file for complete search history.

(56) References Cited

U.S. PATENT DOCUMENTS

| | | | | |
|---|---|---|---|---|
| 3,754,501 A * | 8/1973 | Horn | B30B 9/30 | 100/215 |
| 4,013,215 A * | 3/1977 | Mercier | B65F 1/0093 | 193/34 |
| 5,007,581 A * | 4/1991 | Douglas | B65F 1/0093 | 193/34 |
| 5,607,112 A * | 3/1997 | Wilson | B02C 18/0084 | 241/100 |
| 5,695,114 A * | 12/1997 | Evans | B65F 1/004 | 220/909 |
| 5,772,112 A * | 6/1998 | Bulcroft | B65F 1/0093 | 232/44 |
| 5,806,759 A * | 9/1998 | Axisa | B65F 1/0093 | 193/34 |
| 6,119,869 A * | 9/2000 | Geiman | B03B 9/06 | 209/702 |
| 7,017,728 B2 * | 3/2006 | Nyquist | B65F 1/0093 | 193/33 |
| 7,419,087 B2 * | 9/2008 | Owen | B65F 1/0093 | 220/908.3 |
| 7,422,144 B1 * | 9/2008 | Importico | B65F 1/0093 | 193/31 R |

(Continued)

*Primary Examiner* — Thomas Randazzo
(74) *Attorney, Agent, or Firm* — Renner, Otto, Boisselle & Sklar, LLP

(57) ABSTRACT

A chute system for a building including: an inlet, through which an item is received; a chute, coupled to the inlet, and an outlet, coupled to the chute. The outlet includes a sealing surface, configured to form a seal with an opening of a receptacle into which the item is to be received. The sealing surface is configured to enable a seal to be formed with different receptacles having different sized or shaped openings.

17 Claims, 7 Drawing Sheets

(56) References Cited

U.S. PATENT DOCUMENTS

| | | | | |
|---|---|---|---|---|
| 7,562,025 | B2 * | 7/2009 | Mallett | B07C 7/005 705/308 |
| 8,474,591 | B1 * | 7/2013 | Coples | E04F 17/12 193/33 |
| 8,523,051 | B2 * | 9/2013 | Clancy | B65F 1/0093 193/34 |
| 2003/0230627 | A1 * | 12/2003 | Newsome | B65F 1/0093 232/43.2 |
| 2015/0368043 | A1 * | 12/2015 | Sundholm | E04F 17/12 406/122 |
| 2016/0159572 | A1 * | 6/2016 | Prewitt | B65F 1/10 193/34 |

* cited by examiner

CHUTE SYSTEM FOR WASTE AND OTHER MATERIALS

RELATED APPLICATIONS

This application claims the benefit of Australian Patent Application No. 2016903356 filed on Aug. 24, 2016. Which is herein incorporated by reference in its entirety.

TECHNICAL FIELD

The present invention relates to chutes for the transport of waste or other materials in a building. In particular, although not exclusively, the present invention relates to chutes for transporting waste from a kitchen area of a house to a bin.

BACKGROUND ART

Waste chutes in apartment buildings are well known. In short, a hole is provided in a wall of the building, for receiving the waste. The hole is coupled to a chute, through which the waste travels, until it reaches a bin.

A problem with such waste chutes of the prior art is that they are expensive to manufacture, and/or costly to install. In many cases, to be commercially viable, the chutes must be installed at the time the building is built.

Furthermore, there are many different configurations of bins, both within a country and around the world. For example, different sized and shaped bins are used in different municipal areas. Similarly, different types of buildings required different chute setups. As such, many different configurations need to be provided, which increases manufacturing and warehousing costs.

A further problem with waste chutes of the prior art is that they are not particularly user friendly. In particular, chutes of the prior art often get blocked as bins become full, and do not seal properly at bin, resulting in the escape of odour.

Similar problems exist for other types of chutes, such as laundry chutes and the like.

As such, there is clearly a need for an improved chute system for waste and other materials.

It will be clearly understood that, if a prior art publication is referred to herein, this reference does not constitute an admission that the publication forms part of the common general knowledge in the art in Australia or in any other country.

SUMMARY OF INVENTION

The present invention is directed to chute systems, which may at least partially overcome at least one of the above-mentioned disadvantages or provide the consumer with a useful or commercial choice.

With the foregoing in view, the present invention in one form, resides broadly in a chute system for a building, the chute system including:

an inlet, through which an item is received;

a chute, coupled to the inlet, and an outlet, coupled to the chute, the outlet including a sealing surface, configured to form a seal with an opening of a receptacle into which the item is to be received, the sealing surface configured to enable a seal to be formed with different receptacles having different sized or shaped openings.

Preferably, the sealing surface comprises a substantially planar surface.

Preferably, the sealing surface comprises one or more resilient members, configured to engage with receptacle. The sealing surface may comprise a plurality of resilient members.

The resilient members may comprise bristles.

Preferably, the sealing surface extends outwardly from an end of the chute.

Preferably, the sealing surface is at least twice the width of the end of the chute. Suitably, the sealing surface is at least three times the width of the end of the chute.

Preferably, the sealing surface is configured to enable a seal to be formed with a receptacle having a substantially rectangular opening, and a receptacle having a substantially circular opening.

Preferably, the sealing surface is configured to enable a seal to be formed with a 240 L bin and a 360 L bin. Suitably, the sealing surface is configured to enable a seal to be formed around bins smaller than 360 L.

Preferably, the outlet comprises a hood. Preferably, the sealing surface is formed on substantially an entire lower surface of hood.

Preferably, the outlet is below the chute. Preferably, the inlet is above the chute. Preferably, the item travels in the chute by gravity.

Preferably, the receptacle is a bin. Suitably, the bin comprises a residential waste bin.

Preferably, the item comprises waste. The waste may include recyclable waste.

Preferably, the system is configured to be installed in a residential building. Suitably, the system is configured to be installed in a multi or single family dwelling. The system may be configured to be installed on a multi level dwelling or a single level dwelling. The system may be configured to be installed in a kitchen.

Alternatively, the system may be configured to be installed in a commercial or industrial building.

Alternatively, the item may comprise laundry.

Preferably, the inlet includes a door.

Preferably, the door includes a sensor, and an actuator, wherein the door is configured to automatically open based upon sensor data from the sensor. The sensor may comprise a proximity sensor. The sensor may comprise a motion sensor.

Preferably, the door includes a lock. Preferably, the system includes a sensor, for detecting the presence of the receptacle, wherein the door is configured to lock when the receptacle is not present.

Preferably, the system includes a sensor, for detecting a level of the receptacle, wherein the door is configured to lock when the receptacle is full.

Preferably, the system includes a light, for indicating the presence of the receptacle and/or a level of the receptacle. Suitably, the light may be configured to illuminate in different colours to represent different levels of the receptacle. The light may be positioned on the door.

Preferably, the chute is modular.

Preferable, at least a portion of the chute is split along a length of the chute, prior to installation.

Preferably, the system includes a venturi vent, which is configured to apply negative pressure to chute.

Preferably, the system includes two inlets, and two chutes. The system may include a single outlet, configured to direct items from each of the chutes into different portions of the receptacle.

Preferably, the system includes one or more retaining slots, at the outlet, for receiving a crate. The crate may be positioned above a portion of the receptacle.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DESCRIPTION OF EMBODIMENTS

Figure 1:
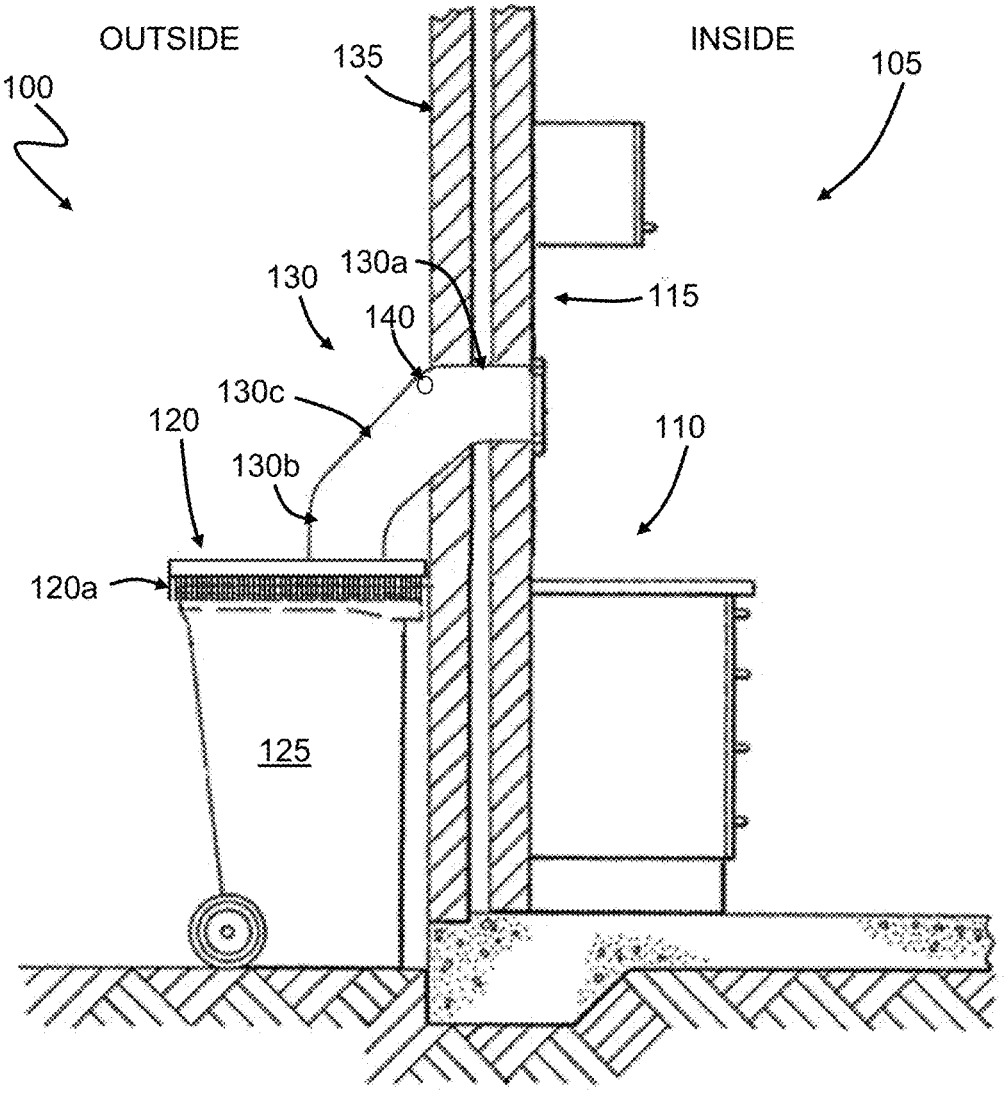
FIG. 1 illustrates a waste disposal system for a building, according to an embodiment of the present invention.

FIG. 1 illustrates a waste disposal system 100 for a building, according to an embodiment of the present invention. The waste disposal system 100 is advantageously placed in a kitchen 105, near a work area 110, to enable a user to dispose of waste, such as food scraps.

The waste disposal system includes waste inputs in the form of doors 115, a hood 120 coupled to a bin 125, and chutes 130 interconnecting doors 115 and the hood 120.

The doors 115 are positioned on an inside of the building in the kitchen. As described in further detail below, the doors 115 are hinged, and are motion activated. In particular, an actuator is configured to open the corresponding door 115 when a user waves their hand in front of that door 115, which may help keep the doors 115 clean.

The doors 115 further include a lock, which, as described in further detail below, prevents the doors 115 from opening when the bin 125 is not in place or is full. This is particularly advantageous as the user may be unable to see if the bin 125 is in place or full from the kitchen 105.

The chutes 130 include a horizontal portion 130*a*, a vertical portion 130*b*, and an angular portion 130*c* transitioning from the horizontal portion to the vertical portion 130*b*. The horizontal portion 130*a* extends from the door 115 through a wall 135. The angular portion 130*c* provides a smooth transition from the horizontal portion 130*a* to the vertical portion 130*b*, reduces the length of the horizontal portion 130*a*, and thus and helps prevent waste from sitting in the chute 130. The vertical portion 130*b* extends downwardly to the hood 120, and is coupled to the hood.

The hood 120 extends over the bin 125, and includes a plurality of bristles 120*a* that engage with the bin 125. In particular, the bristles 120*a* extend downwardly from a base of the hood 120, and create a seal with an upper edge of the bin 125. This seal then prevents access to the bin 125 by vermin or insects, and helps prevent odour from escaping from the bin 125.

As described in further detail below, the hood 120 provides a multi fit seal, enabling any suitable size and shape of bin to be used. This reduces manufacturing and warehousing costs, as a single hood 120 may be manufactured for multiple bin types. Similarly, this enables the system 100 to be adapted in case the bin 125 is changed.

Finally, the system 100 includes a venturi vent 140 which is configured to apply negative pressure to chute 130, promoting suction of air from the building outwards. This in turn prevents smell from entering the kitchen 105 from the bin 125.

Figure 2:
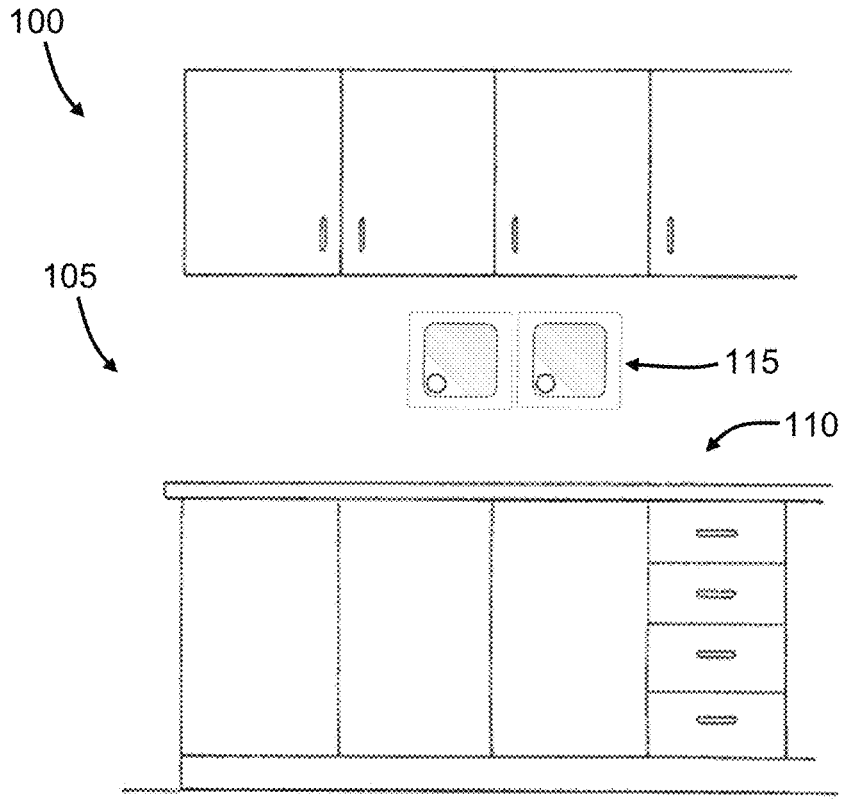
FIG. 2 illustrates the waste disposal system of FIG. 1, from the perspective of a kitchen of the building, according to an embodiment of the present invention.

As illustrated in FIG. 2, the system 100 includes two doors 115 located adjacent to each other. Separate chutes 130 are coupled to each of the doors, enabling separate types of waste (e.g. food and recycling) to be transported separately. As described in further detail below, the bin 125 may be partitioned into separate portions, the separate portions for receiving the different types of waste.

Figure 3:
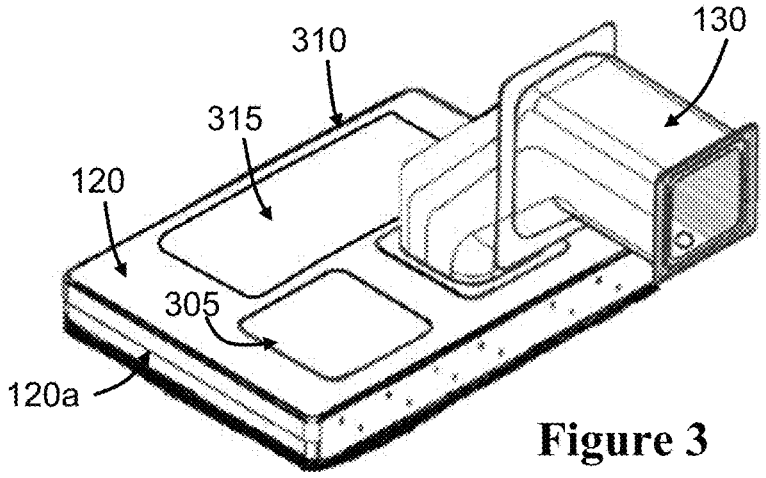
FIG. 3 illustrates a perspective view of a hood of the system of FIG. 1, with one chute attached, according to an embodiment of the present invention.
Figure 4:
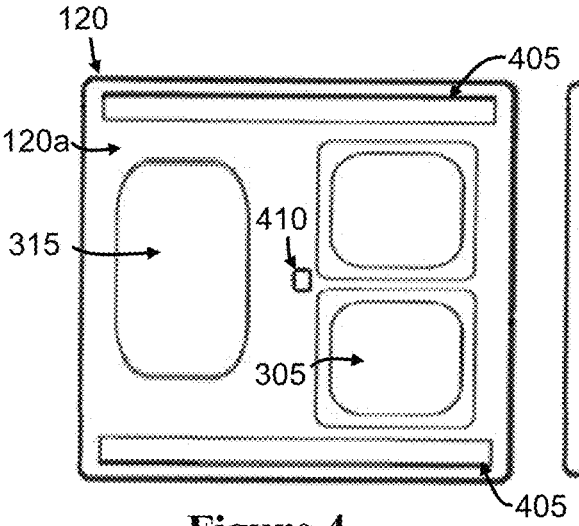
FIG. 4 illustrates a bottom view of the hood of FIG. 3.

FIG. 3 illustrates a perspective view of the hood 120, with one of the chutes 130 attached. FIG. 4 illustrates a bottom view of the hood 120, FIG. 5 illustrates a top view of the hood 120, FIG. 6 illustrates an end view of the hood 120, and FIG. 7 illustrates a side view of the hood.

Figure 5:
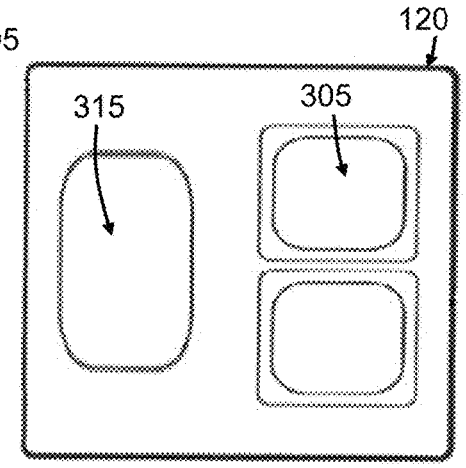
FIG. 5 illustrates a top view of the hood of FIG. 3.

As best illustrated in FIGS. 3 and 5, the hood 120 includes apertures 305 extending through a body 310, enabling waste from the chutes 130 to travel through the hood 120 and into the bin 125. The apertures are approximately of approximately the same shape as a cross section of the chute 130, to enable a smooth transition from the chutes 130 into the bin.

The apertures 305 are spaced on the hood 120 in approximately the same relationship as the doors 115 in the kitchen 105, which enables the chutes 130 to extend downwards to the hood 120 directly beside each other.

Figure 6:
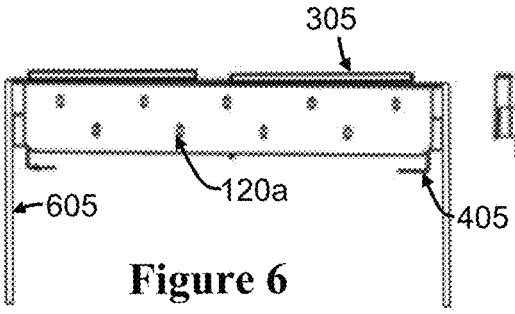
FIG. 6 illustrates an end view of the hood of FIG. 3.
Figure 7:
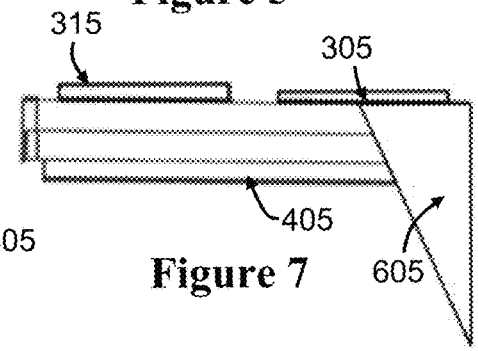
FIG. 7 illustrates a side view of the hood of FIG. 3.

As best illustrated in FIGS. 4, and 6-7, the hood includes a pair of retaining slots 405, supported by the body 310. The retaining slots 405 enable a crate (not illustrated) to be supported by the hood 120, for receiving the waste.

The crate may comprise a wire mesh crate configured to support a paper bag, for receiving the waste. The crate may be configured to receive waste from a single chute 130, or from both chutes. As such, the hood 120 may be used with the bin 125 only (i.e. without a crate, with a combination of a bin 125 and a crate (e.g. where the crate is configured to receive one type of waste and the bin is configured to receive another, or with a crate only (i.e. the crate is used instead of the bin 125).

The bristles 120*a* extend outwardly from the base 310 and between the retaining slots 405, and as such, provide a seal to the bin 125, in case the bin is used, and/or to the crate, in case the crate is used.

The hood further includes a rectangular hinged lift-up door hatch 315, to enable a user to dispose of waste directly in the bin. In particular, when the lift-up door hatch 315 is lifted, an aperture is exposed that provides direct access to the bin. The hatch 315 can also be used to manually monitor whether the bin is full, or to compact waste down in the bin without having to move the bin or hood.

A top of the lift-up door hatch 315 is slightly inclined, away from the building, to allow water to run off, away from the building.

As best illustrated in FIGS. 6 and 7, the hood includes wall mounting brackets 605, which secure the hood to the wall. The brackets 605 are adjustable, enabling the height of the hood to be fine tuned after installation.

Finally, the hood 120 includes a proximity sensor 410, to detect the presence of a bin or crate, and to detect whether the bin and/or crate is full. As described in further detail below, the proximity sensor 410 is coupled to a controller, which in turn is configured to lock the doors 115, to prevent use of the system 100 when the bin 125 is not in place or is full.

The skilled addressee will readily appreciate that the proximity sensor 410 may comprise separate proximity sensors for different compartments of the bin, or a combined proximity sensor that is configured to measure several compartments of the bin.

While the hood includes two apertures 305, the skilled addressee will readily appreciate that in some cases, only one of the apertures 305 may be used. In such case, a cover plate (not illustrated) is provided to cover the aperture 305 in the hood that is not being used.

Figure 8:
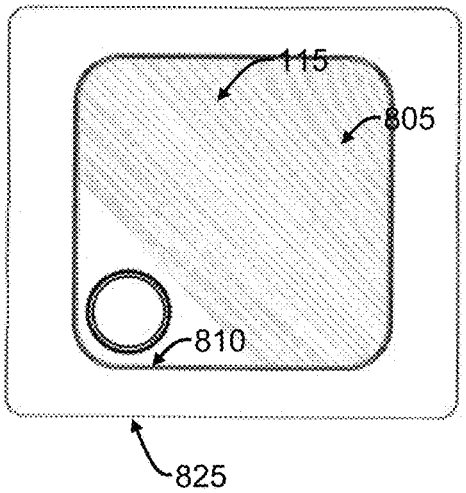
FIG. 8 illustrates a front view of a door of the system of FIG. 1, according to an embodiment of the present invention.
Figure 9:
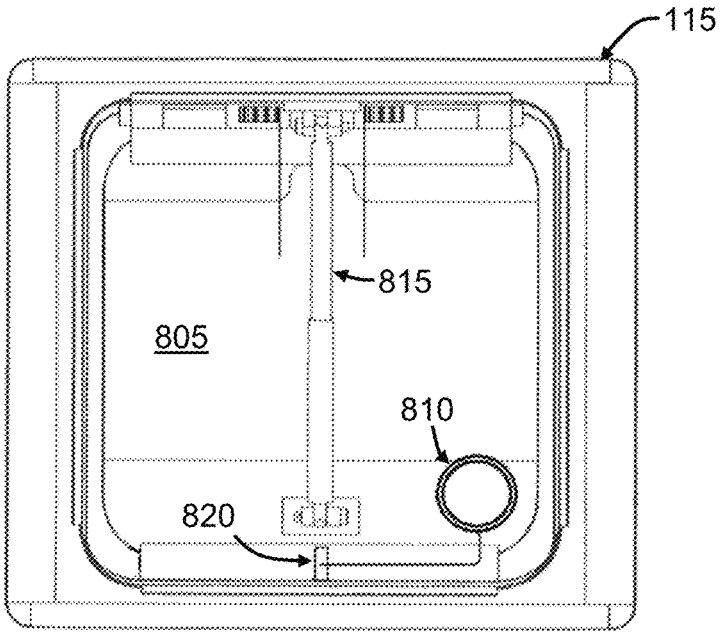
FIG. 9 illustrates a review view of the door of FIG. 8.

FIG. 8 illustrates a front view of the door 115 of the system, according to an embodiment of the present invention. FIG. 9 illustrates a rear view of the door 115.

The door includes a hinged door flap 805, which is configured to open when the users hand is in proximity to the door flap 805. In particular, the door 115 includes a proximity sensor 810, which is coupled to a controller (not illustrated), which is in turn configured to activate an actuator 815 according to sensor data from the proximity sensor 810.

This enables the door flap 805 to be opened without the user contacting the door flap 805, or the door 115 otherwise, which is advantageous from a hygiene and cleanliness perspective.

The door 115 further includes a lock 820, which is configured to prevent the door flap 805 from opening, when activated. The lock 820 is electrically controlled, and is coupled to the controller, which is configured to activate the lock 820 when the bin is full or not present. As such, the lock 820 prevents waste from backing up inside the chute 130, or from falling onto the ground.

Finally, the door 115 includes an LED indicator 825. The LED indicator 825 is configured to illuminate when the door is locked, so that the user is able to immediately see that the system 100 is inoperable, and take appropriate action.

According to certain embodiments, the LED indicator 825 is configured to display a level of waste in the bin 125 using different colours. For example, the LED indicator 825 may show a green light in case the bin is under half full, an orange light when the bin is over half full, and a red light when the bin is full or not present.

The door flap 805 is advantageously stainless steel, to simplify cleaning and to provide an aesthetically pleasing door flap 805. Preferably, the stainless steel is chemically etched with a diagonal pattern, to reduce the appearance of scratches, which may be caused by cans and metallic waste The door flap 805 advantageously includes a spring, configured to bias the door flap 805 in a closed position. The spring in such case assists in the sealing of the door flap when not in use.

Finally, the door flap 805 may include indicia, or colour coding, to indicate what type of waste is to be provide in each of the door flaps 805. This is particularly advantageous when multiple door flaps 805 are provided for different types of waste, such as general waste, recycling, compost, paper/cardboard and glass.

Figure 10:
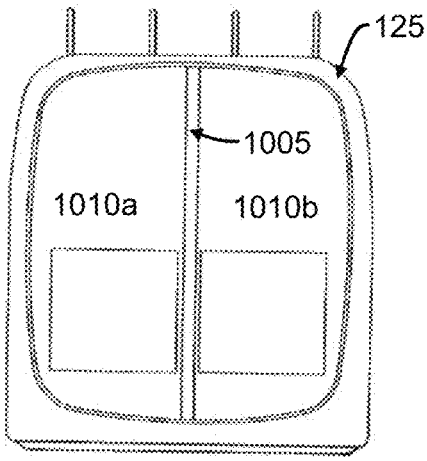
FIG. 10 illustrates a top view of a bin of the system of FIG. 1, according to an embodiment of the present invention.

FIG. 10 illustrates a top view of the bin 125, according to an embodiment of the present invention. The bin 125 includes a bin divider 1005, splitting the bin 125 into two compartments 1010*a*, 1010*b*.

The chutes 130, and in particular the apertures 305 of the hood 120 align with respective compartments 1010 of the bin. As such, different types of waste can be received in the bin 125, and separated, for later processing.

Figure 11:
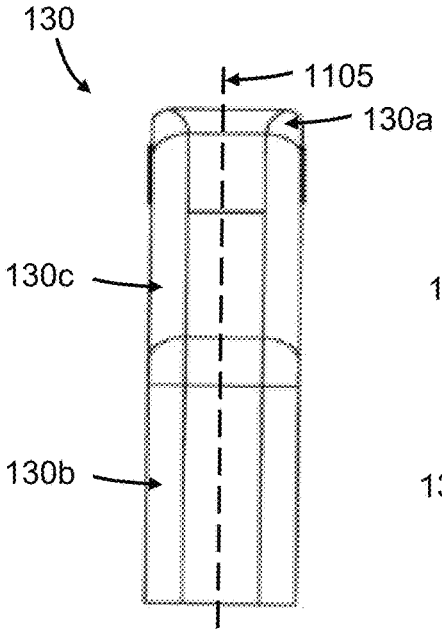
FIG. 11 illustrates a rear view of a chute of the system of FIG. 1.
Figure 12:
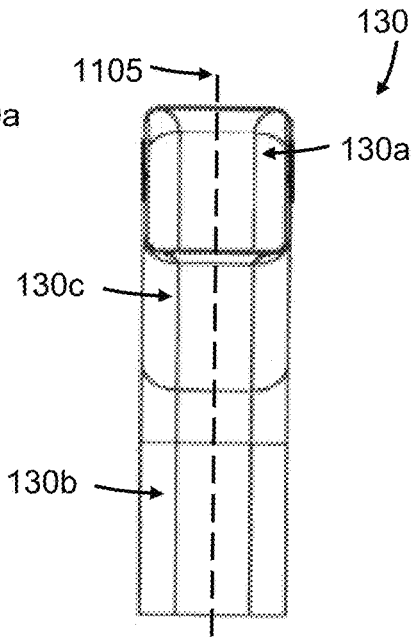
FIG. 12 illustrates a front view of the chute of FIG. 11.

FIG. 11 illustrates a rear view of the chute 130, and FIG. 12 illustrates a front view of the chute 130.

The chute 130 is modular, and configured so that the horizontal portion 130*a*, the vertical portion 130*b*, and the angular portion 130*c* are separately provided, and are jointed on site. The horizontal and vertical portions 130*a*, 130*b* are configured to be cut to size, to enable the chute 130 to be adapted to various wall thicknesses and building heights.

Furthermore, each of the chute portions 130*a*, 130*b*, 130*c* is configured to be split along an axis 1105 of the chute. This enables halves of the chute portions to be stacked within each other, providing more compact storage and transportation of components.

Figure 13:
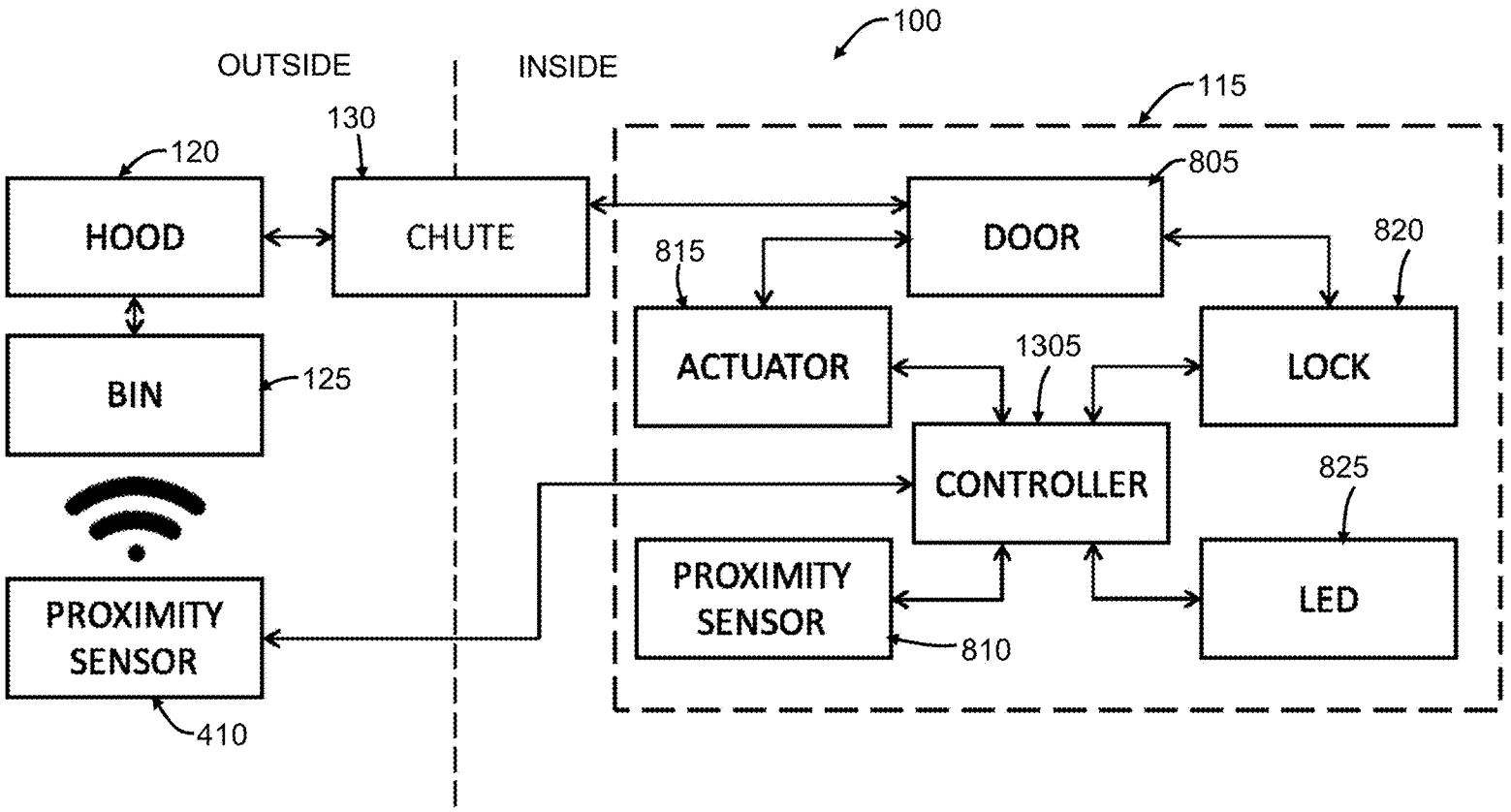
FIG. 13 illustrates a schematic of the system of FIG. 1, according to an embodiment of the present invention.

FIG. 13 illustrates a schematic of the system 100, according to an embodiment of the present invention.

As described above, the door flap 805 of the door 115 is coupled to the chute 130, which is in turn coupled to the bin 125, to enable waste to flow from the door flap 805 to the bin 125.

The proximity sensor 410 is configured to sense a presence of the bin 125, and a level of waste in the bin 125. The sensor 410 is coupled to the controller 1305, which is in turn coupled to the lock 820 and light 825. The controller 1310 is configured to receive the signal from the sensor 410, activate the lock in case the bin is not present or full, and configure the light 825 to illuminate accordingly.

According to certain embodiments, adapters may be provided for the chute 130. This is particularly advantageous if the door 115 is not immediately adjacent to an external wall, if the door 115 is on a second storey of a building, or any other scenario where a different size or shape of chute is required.

Figure 14:
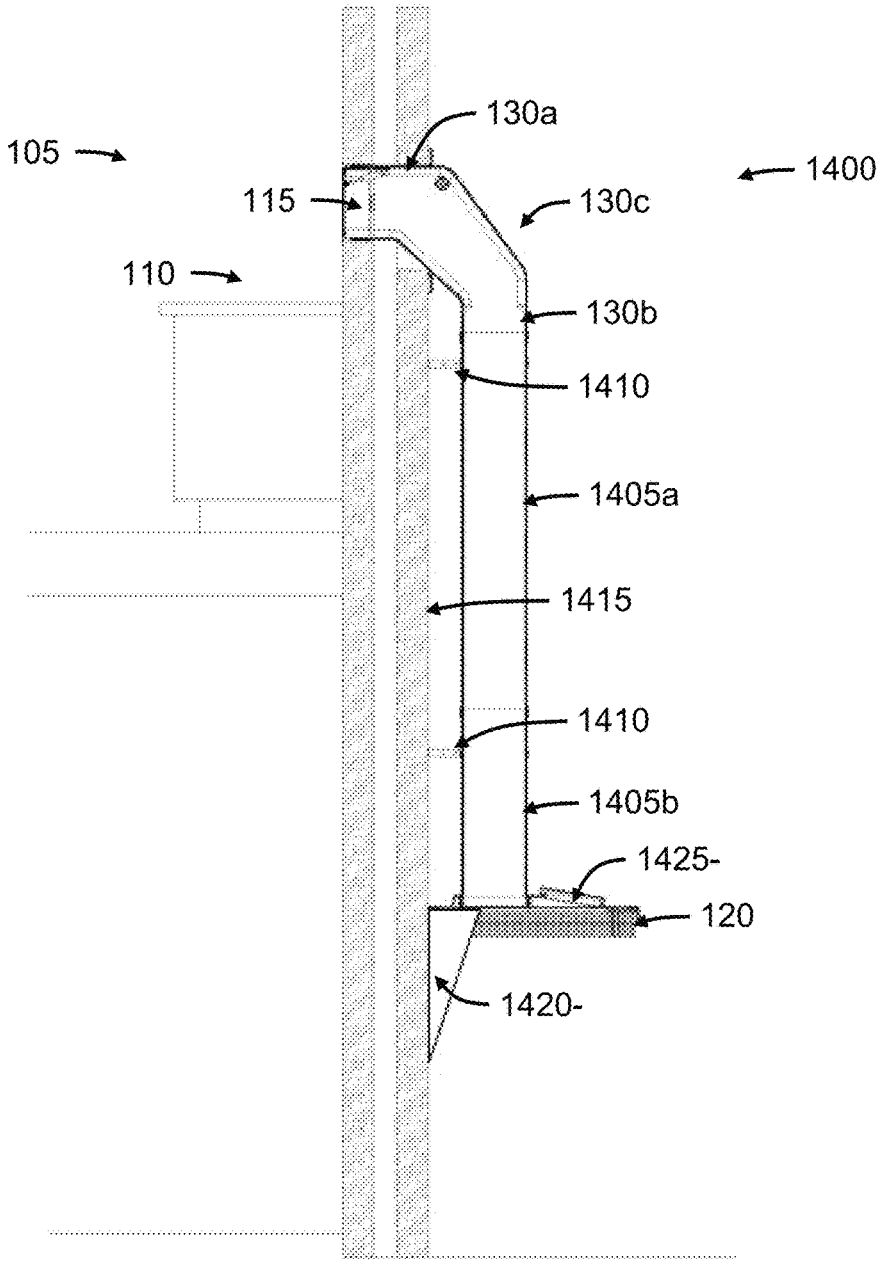
FIG. 14 illustrates a waste disposal system, according to an alternative embodiment of the present invention.

FIG. 14 illustrates a waste disposal system 1400, which is similar to the waste disposal system 100, but in a second floor configuration, according to an embodiment of the present invention.

The waste disposal system includes chute 1405 comprising a horizontal portion 130*a*, a vertical portion 130*b*, and an angular portion 130*c*, similar to the system 100, and first and second vertical spacers 1405*a*, 1405*b*. The vertical spacers 1405*a*, 1405*b* are used to extend a length of the chute 1405.

The system 1400 further includes support brackets 1410, coupling the chute 1400 to a wall 1415 of the building. The system 1400 further includes support brackets 1420 coupling the hood 120 to the wall.

The hood 120 includes a hinged lift-up door hatch 1425, similar to the door hatch 315, to enable a user to dispose of waste directly in the bin, to manually monitor whether the bin is full, or to compact waste down in the bin. The lift-up door hatch 1425 is inclined, away from the building, to allow water to run off, away from the building.

The wall 1415 of FIG. 14 is a double brick wall. However, the system 1400 may be used in brick veneer or single wall construction. In particular, the horizontal portion 130*a* may be adapted to suit a thickness of the wall.

According to certain embodiments, more than two waste chutes may be provided in a waste system. In other embodiments, a single waste chute may be provided.

Figure 15:
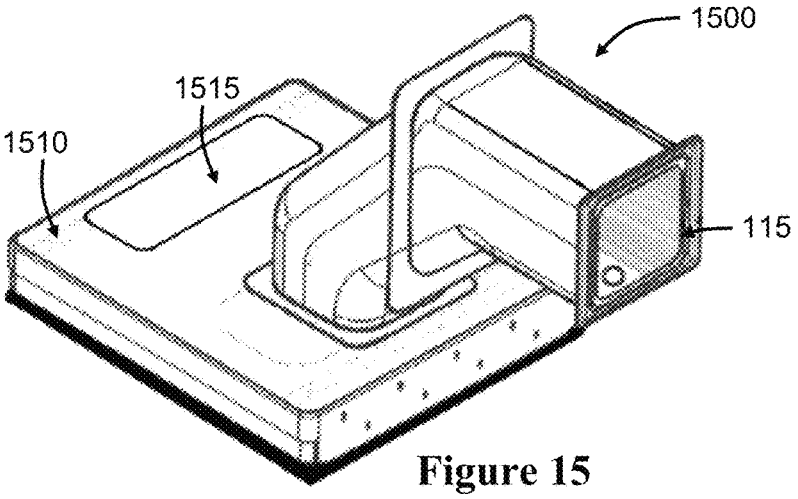
FIG. 15 illustrates a perspective view of a portion of a waste disposal system, according to yet an embodiment of the present invention.

FIG. 15 illustrates a perspective view of a portion of a waste disposal system 1500, according to an embodiment of the present invention. The waste disposal system 1500 is similar to the waste disposal system 100, but with a single chute 1505 and a square shaped hood 1510.

The hood 1510 includes a hinged door 1515, much like the hinged doors described earlier, which enable the user to access the bin from above, without removing the bin.

As discussed above, the hoods provide a multi-fit seal against bins and/or cages of various sizes. In particular, the underside of the hood is provided with bristles that extend from immediately adjacent to the chute, enabling a small bin to be positioned under the chute, to an edge of the hood, enabling a large bin to be positioned under the chute. Furthermore, the hood enables different shaped bins to be used, including round and rectangular shaped bins.

Figure 16:
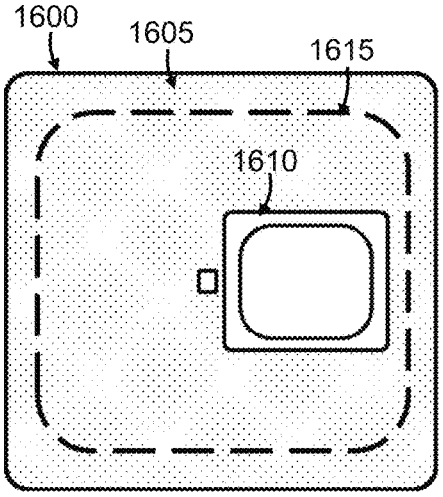
FIG. 16 illustrates an underside of a hood of a waste disposal system, in a first configuration, according to an embodiment of the present invention.

FIG. 16 illustrates an underside of a hood 1600, in a first configuration, according to an embodiment of the present invention. The hood 1600 is similar to the hood 1510 of FIG. 15, and includes a plurality of bristles 1605 on an underside of the hood 1600.

The bristles 1605 extend from an opening 1610 of the chute, in a central portion of the hood 1600, continuously to an outer edge of the hood 1600. This enables the hood to suit various size bins.

FIG. 16 illustrates an outline of a relatively large bin 1615, which is substantially rectangular in shape, which is sealed by an outer edge of the bristles 1605.

Figure 17:
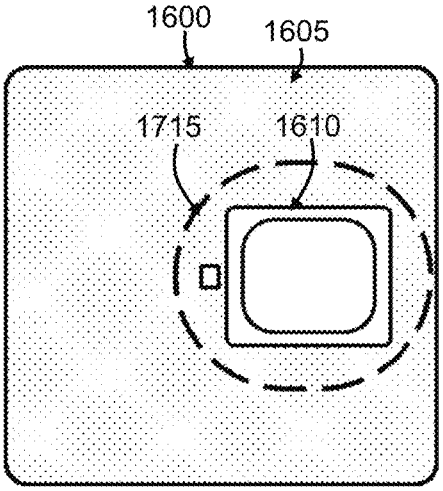
FIG. 17 illustrates an underside of the hood of FIG. 16, in a second configuration.

FIG. 17 illustrates an underside of the hood 1600, in a second configuration, and illustrates an outline of a relatively small bin 1715, which is substantially circular in shape, which is sealed by an inner edge of the bristles 1605.

As can be seen from FIGS. 16 and 17, the hood 1600 enables virtually and shaped bin to be used which is a) larger than the opening 1610, and smaller than the hood 1600.

According to certain embodiments, the hoods described above are configured to be used with a bin that is up to about 360 lt in size. The hood is preferably also configured to receive a 240 lt bin.

The hoods may be configured to receive a bin that is split in either an east/west or north/south orientation by rotating the hoods to the desired configuration.

Advantageously, the hoods allows for the bin to be pushed in under the hood from the front, or either sides. This is particularly advantageous when the system is used in a narrow area, where manoeuvrability of the bin is limited.

The hood 1600 in FIGS. 16 and 17 is illustrated with a single aperture/chute. The skilled addressee will readily appreciate that other chutes may include two apertures, which together may provide three single chute configurations—single chute (central), as illustrated in FIGS. 16 and 17, single chute (left), and single chute (right).

While the above embodiments illustrate the chute extending outwardly through a wall, the skilled addressee will readily appreciate that the chute may extend through a floor. For example, a bin may be placed underneath the building (e.g. in a highset dwelling), or in a garage on a lower floor. In such case, the door may be placed in a bench-top or through the front of a cupboard.

While the above embodiments have been described with reference to a waste disposal system, the skilled addressee will readily appreciate that any other suitable item may be used. For example, the embodiments described above may be adapted to be used for laundry, or other non-waste items.

According to certain embodiments, the systems above may be modified to include a larger door, and a larger chutes. This is particularly advantageous in case the systems are to be used with laundry, such as bedding, or if waste (or other items) are put into bags before being used with the system.

According to certain embodiments, the chutes may be designed to include telescoping means for adjusting chute length. Such telescoping means is particularly useful at installation, as it does not require exact height measurements of the building where the system is to be installed.

Advantageously, the systems described herein are particularly suited to kitchens in single family dwellings. The systems are simple to use, and prevent overfilling and accidental use when the bin is not present.

The systems have reduced manufacturing costs, as a single hood/system is able to be used with various bin configurations. In particular, the multi-fit hood enables small and large bins to be used, as well as bins of various different shapes.

The venturi vent 140 prevents smell from the bin from entering into the kitchen, and the hood seal prevents vermin from accessing the bin.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A chute system for a building, the chute system including:

an inlet, through which an item is received;

a chute, coupled to the inlet;

a door located between the inlet and the chute to seal the inlet;

a venturi vent in the chute on an outer side of the door; and an outlet hood, coupled to the chute, configured to fit over an opening of a receptacle into which the item is to be received, the outlet hood provided with an outlet opening in communication with the chute and a multi-fit bristle sealing surface on an underside of the hood configured to form a bristle seal with an opening of a receptacle into which the item is to be received, the multi-fit sealing surface configured to enable a seal to be formed with different receptacles having different sized or shaped openings, the bristle seal spacing an underside of the outlet hood from the opening of the receptacle.

2. The system of claim 1, wherein the multi-fit bristle sealing surface comprises a substantially planar surface.

3. The system of claim 1, wherein the multi-fit bristle sealing surface comprises one or more resilient members, configured to engage with receptacle.

4. The system of claim 1, wherein the multi-fit bristle sealing surface extends outwardly from an end of the chute.

5. The system of claim 1, wherein the multi-fit bristle sealing surface is at least twice the width of the end of the chute.

6. The system of claim 1, wherein the multi-fit bristle sealing surface is configured to enable a seal to be formed with a receptacle having a substantially rectangular opening, and a receptacle having a substantially circular opening.

7. The system of claim 1, wherein the multi-fit bristle sealing surface is configured to enable a seal to be formed with a 240 L bin and a 360 L bin.

8. The system of claim 1, wherein the outlet comprises a hood, and wherein the multi-fit bristle sealing surface is formed on substantially an entire lower surface of hood.

9. The system of claim 1, wherein the receptacle comprises a residential or commercial waste bin and wherein the item comprises waste.

10. The system of claim 1, wherein the system is configured to be installed in a kitchen of a residential or commercial building.

11. The system of claim 1, wherein the door includes a sensor, and an actuator, wherein the door is configured to automatically open based upon sensor data from the sensor.

12. The system of claim 1, including a light, for indicating the presence of the receptacle and/or a level of the receptacle.

13. The system of claim 1, wherein at least a portion of the chute is split along a length of the chute, prior to installation.

14. The system of claim 1, including two inlets, and two chutes coupled to the outlet, wherein the outlet is configured to direct items from each of the chutes into different portions of the receptacle.

15. The system of claim 1, wherein the system includes one or more retaining slots, at the outlet, for receiving a crate or recycling bag, wherein the crate or recycling bag is positioned above a portion of the receptacle.

16. The system of claim 1, wherein the door includes a lock, and the system includes a sensor, for detecting the presence of the receptacle, wherein the door is configured to lock when the receptacle is not present.

17. The system of claim 16, wherein the system further includes a level sensor, for detecting a level of the receptacle, wherein the door is further configured to lock when the receptacle is full.

* * * * *